US007846003B2

(12) United States Patent
Takiguchi et al.

(10) Patent No.: US 7,846,003 B2
(45) Date of Patent: Dec. 7, 2010

(54) ACTION FIGURE FABRICATION TOY

(76) Inventors: Yusuke Takiguchi, 5551 Katella Ave., Cypress, CA (US) 90630; Kenichi Morita, 95 Queensway United Center RM. 2902, 29th Floor, Hong Kong (CN)

( * ) Notice: Subject to any disclaimer, the term of this patent is extended or adjusted under 35 U.S.C. 154(b) by 227 days.

(21) Appl. No.: 11/973,154

(22) Filed: Oct. 5, 2007

(65) Prior Publication Data

US 2009/0093186 A1 Apr. 9, 2009

(51) Int. Cl.
*A63H 3/16* (2006.01)
*A63H 3/12* (2006.01)
*B23P 19/00* (2006.01)

(52) U.S. Cl. ..... 446/97; 446/321; 29/428; 29/805

(58) Field of Classification Search ..... 446/71–73, 446/77, 78, 85, 97, 99, 101, 268, 321, 330, 446/486, 98, 375, 424, 491; 29/406, 418, 29/428, 469, 795, 805; 273/276
See application file for complete search history.

(56) References Cited

U.S. PATENT DOCUMENTS

D221,008 S * 6/1971 Irons ..... D21/725
4,669,998 A * 6/1987 Amici et al. ..... 446/383
4,869,701 A * 9/1989 Kawai et al. ..... 446/91
5,788,554 A * 8/1998 Goodwin et al. ..... 446/100
5,897,420 A * 4/1999 Lawrence et al. ..... 446/321
6,438,842 B1 * 8/2002 Raami ..... 29/897.2
6,537,130 B1 * 3/2003 Lee et al. ..... 446/375
6,887,120 B2 * 5/2005 Shamitoff ..... 446/99
7,520,793 B2 * 4/2009 Pillai et al. ..... 446/97

* cited by examiner

*Primary Examiner*—Gene Kim
*Assistant Examiner*—Scott Young
(74) *Attorney, Agent, or Firm*—Benjamin C. Deming

(57) ABSTRACT

An action figure fabrication toy in which a preselected action figure torso is placed in the center of the toy and individual body parts for the action figure are then placed in separate chambers arranged circumferentially about the center on opposite sides. The toy is then activated and one body part from each chamber is selected and automatically attached to the preselected torso, in order to form a composite action figure comprised of the torso and each of the selected body parts from each of the separate chambers.

12 Claims, 8 Drawing Sheets

ACTION FIGURE FABRICATION TOY

FIELD OF THE INVENTION

The invention generally relates to toy action figures and, more specifically, to a toy for fabricating/constructing toy action figures.

BACKGROUND OF THE INVENTION

Toy action figures are well known in the art and are generally comprised of a torso with a head, arms and legs attached thereto. In some embodiments, the head, arms and/or legs are moveable in relation to the torso, thereby creating a life-like action figure. Most action figures come pre-assembled in a box or container; although some of these pre-assembled figures may come with removeable body parts and/or substitute parts/portions so that all or part of the action figure can be removed and the action figured then reassembled using the substitute parts/portions.

Other actions figures are sold as separate components which must be purchased and then assembled by the user. There are several alternate well known toys on the market in which an individual can attempt to build his or her own action figure—such as LEGO™, BIONICLES™, and STIKFAS™.

One common disadvantage in these known action figures is that they come pre-assembled or with known parts designed to be assembled in a known and/or described pattern—i.e they typically come with component parts, all of which are designed to be assembled in a set or known pattern in order to create a desired appearance for the action figure. Although some of these action figures allow for some degree of substitution in order to achieve variant appearances of the action figure, such does not allow for any real originality or creativity.

Accordingly, what is needed is a means and method for creating a unique and original action figure assembled from a selection of component body parts. What is further needed is a means and method for allowing a user to construct an action figure from a myriad or plurality of component body parts such that the user may build several different variations either as desired or randomly. Finally, what is needed is a means and method for automatically constructing an action figure from a random subset of a plurality of component body parts in order to assemble a completely unique and different action figure.

SUMMARY OF THE INVENTION

The invention is for an action figure fabrication toy in which a preselected action figure torso, preferably a toy alien action figure torso (although the invention is designed to work with any type of action figure comprised of a plurality of body parts), is placed in the center of the toy and individual body parts for the action figure are then placed in separate chambers arranged circumferentially about the center on opposite sides. The toy is then activated and one body part from each chamber is selected and automatically attached to the preselected torso, in order to form a composite action figure having a torso, legs, two arms, and a head.

The body parts used/selected may be specifically selected by the user and/or they may be randomly selected, such that the final composite action figure which is assembled may be designed with a particular appearance in mind or it may be a random combination of body parts—thereby forming a unique action figure.

DETAILED DESCRIPTION OF PREFERRED EMBODIMENTS

The invention is for an action figure fabrication toy in which a preselected action figure torso is placed in the center of the toy and individual body parts for the action figure are then placed in separate chambers arranged circumferentially about the center on opposite sides. The toy is then activated and one body part from each chamber is selected and automatically attached to the preselected torso, in order to form a composite action figure comprised of the individual body parts, including a torso, legs, two arms, and a head. More specifically, a plurality of body parts are arranged in each chamber and one of these parts is then selected from each chamber and automatically coupled to the action figure torso. As discussed in further detail later herein, the selection can be by design or it can be completely random.

Figure 1:
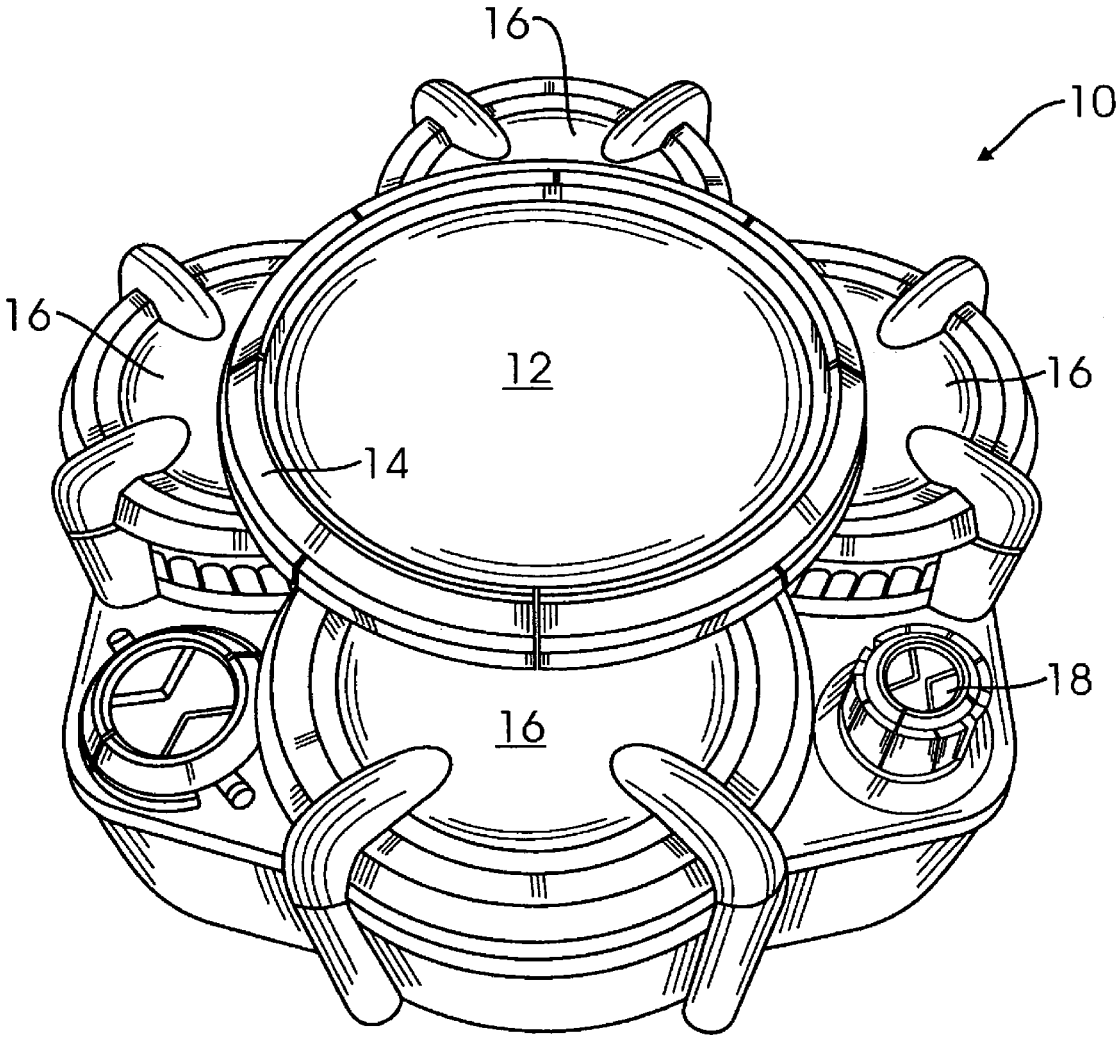
FIG. 1 illustrates a top side perspective view of the action figure fabrication toy of the present invention.

FIG. 1 illustrates a top side perspective view of the action figure fabrication toy of the present invention. As shown, the invention is preferably comprised of a large, preformed unit 10 which may be made from any one or a combination of various materials including plastic and/or metal. The unit 10 preferably has a central chamber 12 which is preferably circular in shape, although other shapes are envisioned and possible—such as square, hexagonal, and/or octagonal. As will be described in greater detail hereinafter, this central chamber is where the action figure is preferably automatically assembled.

The central chamber 12 is preferably covered by a removable lid 14. The lid 14 preferably has a window 15 through which the user can see into the internal cavity of the central chamber 12 (i.e. into the unit) in order to observe the assembly of the action figure as it is assembled. The lid may also optionally include a cover for the window which when placed over (or behind) the window, prevents viewing in the internal cavity of the central chamber, thereby concealing what is happening inside.

In a preferred embodiment, a torso piece for an action figure is placed and retained within the central chamber 12. As explained earlier, although this invention may hereinafter be described with reference to a toy alien action figure, it is designed and adaptable for use in assembling any type of action figure so in general this will be referred to as the "torso piece." It is further noted that in a preferred embodiment, a user may select the torso piece to be used from a plurality of available torso pieces. Accordingly, the torso piece is pre-selected by a user and placed in the central chamber 12 for assembling an action figure, as further described hereinafter.

Referring still to FIG. 1, the invention further includes a plurality of additional smaller chambers 16 which are positioned circumferentially about the central chamber 12. In a preferred embodiment, the invention will include at least four additional smaller chambers, although it is possible to have a smaller number, such as two or three, or a larger number, such as five or six. The number of additional smaller chambers is dependent upon the number of individual body parts designed to be coupled to the torso piece. More specifically, each of these additional smaller chambers 16 will hold a plurality of body parts for the alien action figure which will be used when it is assembled. In a preferred embodiment, a portion of each of these chambers is also visible through the window of the removeable lid 14 such that when the lid is placed over the toy, a user can still see a portion of each of these at least four additional smaller chambers 16—as will be described in greater detail later hereinafter.

Finally, still referring to FIG. 1, the invention further also includes an activation dial 18 which is located on a front surface of the unit and which, when twisted in a first direction, activates the toy, thereby causing one of the body parts from each of the additional smaller chambers to move toward and eventually fasten and/or couple to the torso piece which is placed in the central chamber, as described in further detail hereinafter.

Figure 2:
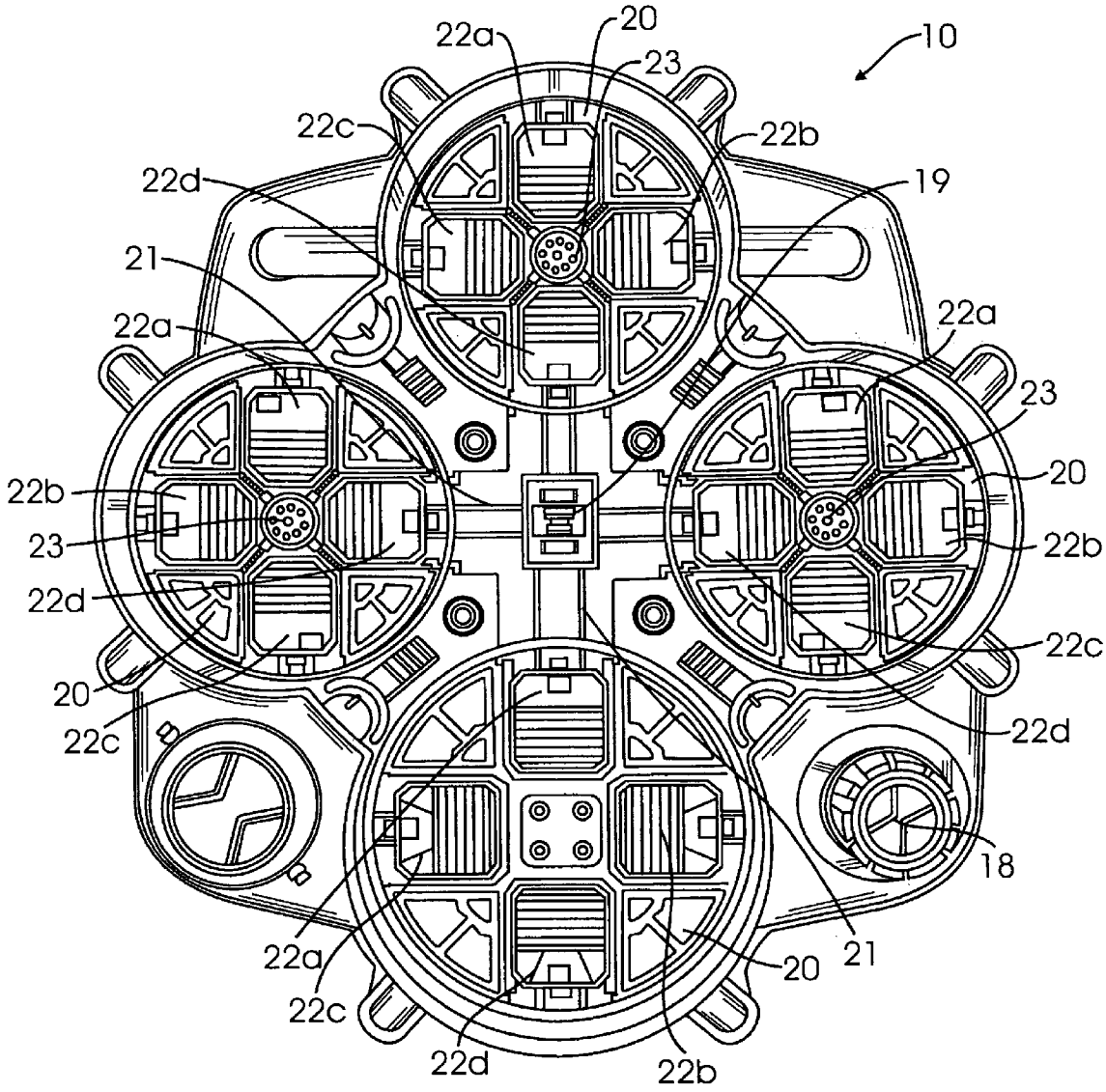
FIG. 2 illustrates an inside perspective view of the action figure fabrication toy of the present invention.

Referring now to FIG. 2, there is shown an inside perspective view of the alien action figure fabrication toy of the present invention. This perspective further illustrates the inside central chamber 12 and the at least four additional smaller chambers 16. As shown, in the middle of the central chamber is positioned a clip or clasp 19, preferably formed of plastic or metal, which is coupled to the floor of the central chamber. This clip or clasp 19 is used to hold an alien action figure torso selected by the user from a plurality of available torso pieces.

As explained earlier herein, in a preferred embodiment a torso piece for an alien action figure is placed and retained within the central chamber 12 (using this clip or clasp 19). A user may select the torso piece to be used from a plurality of torso pieces. The torso piece is pre-selected by a user and placed within the central chamber. In a preferred embodiment, the torso piece is held in place using the clip or clasp 19. More specifically, each torso piece preferably has an opening on a back side of the piece, centrally located thereon. The clip or clasp 19 is preferably pinched together and the alien action figure torso piece is placed over the clip or clasp 19, so that the clip or clap is received into this opening on the back side (the clip or clasp fits within this opening). In a preferred embodiment, when the action figure piece is placed onto the clip or clasp 19, a plurality of small fastening apertures open on various sides of the torso piece. The various alien action figure body parts will couple to the torso piece via these small fastening apertures and fastening posts resident on and integral with each of the body part pieces, as explained in further detail hereinafter.

As further shown in FIG. 2, the clip or clasp 19 is surrounded by a plurality of tracks 21, one track leading to each of the additional smaller chambers 16. As will be described in greater detail hereinafter, these tracks 21 allow body parts positioned in each of the smaller chambers to move toward, and eventually couple to, the torso piece held in the clip or clasp 19 of the central cavity. More specifically, and as further shown in FIG. 2, each of the four additional smaller chambers 16 has a circular shaped floor 20 which is configured to be rotatable/spinnable, preferably in a clockwise direction, about a central axis 23. This circular floor 20 further includes at least four separate sliding pieces 22*a-d* which are configured and enabled to move outward, in a radial fashion, away from the central axis 23 of that smaller chamber, and inward toward the central chamber, when the toy is activated. In practice, the floors 20 in each of the smaller chambers 16 will be manually rotated, using a selection dial (as further described hereinafter) and then one piece from each of the at least four smaller chambers 16 is moved outward, away from the central axis of that smaller chamber, and toward the torso in the central cavity/chamber, along one of the plurality of tracks, when the activation dial 18 is turned. Accordingly, as will be described in greater detail further hereinafter, these tracks 21 serve to guide moveable sliding pieces 22*a-d* (one from each smaller chamber) away from the smaller chamber and toward the center of the central chamber (toward the torso piece).

Figure 3:
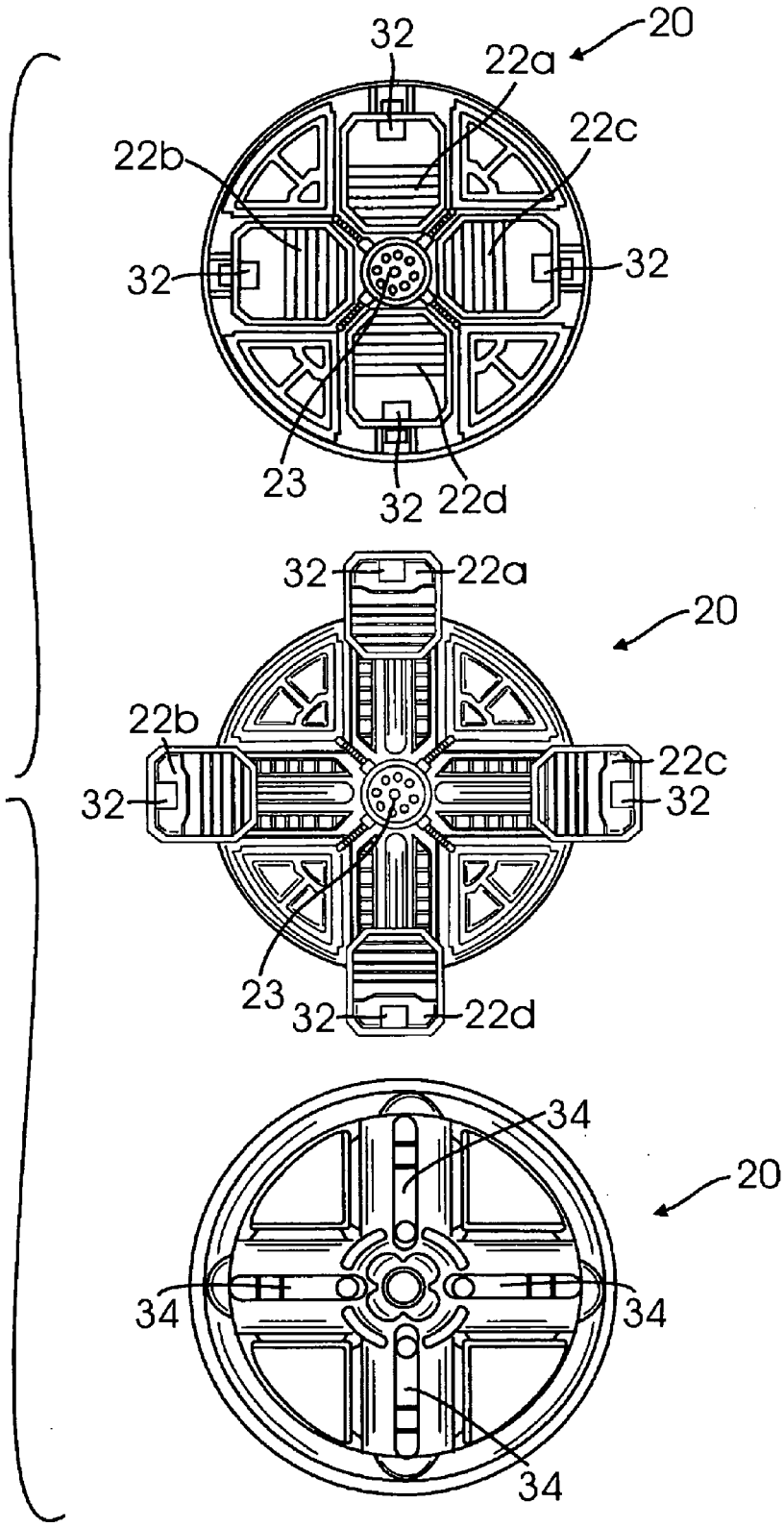
FIG. 3, illustrates a break out for a circular shaped floor of one of the smaller chambers which specifically illustrates how the rotating floor in each individual smaller chamber 16 has four sliding pieces which move outward.

Referring to FIG. 3, it shows a break out for a circular shaped floor 20 of one of the smaller chambers 16 which specifically illustrates how the rotating floor 20 in each individual smaller chamber 16 has four sliding pieces which move outward. As shown in the top view of FIG. 3, in a first position the at least four sliding pieces are all arranged radially, in a closed position, about a central axis 23. Each of the at least four sliding pieces 22*a-d* has a retaining aperture 32 which is visible and accessible from the top of the toy. This aperture is used for placing the plurality of action figure body parts within the smaller chamber, as described in greater detail further hereinafter. As shown in the middle view of FIG. 3, each of the at least four sliding pieces 22*a-d* is capable of sliding outward, in a radial direction away from the central axis 23 of that smaller chamber, and inward toward the central chamber (and toward the torso piece). Finally, as shown in the bottom view of FIG. 3 the movement of the sliding pieces in an outward direction is made possible through the use of a track type interface 34 by which the underside of each sliding piece may be "grabbed" or otherwise engaged by a mechanical mechanism and then pushed along a central track, moving the piece outward in a radial direction, away from the central axis 23. More specifically, below each circular shaped floor of each smaller chamber is a rotational mechanism for rotating the floor, preferably in a clockwise direction. Furthermore, below each for is a mechanical mechanism for "grabbing" or otherwise engaging one of the sliding pieces (preferably the piece closest to the central chamber) and moving that piece outward, away from the central axis of that smaller chamber, along the track type interface 34, and toward the central chamber/cavity where the torso piece is located.

Accordingly, as the floor is rotated from one position to another, the track type interface 34 aligns with the tracks 21 which extend outward away from the clip or clasp 19 in the central chamber The mechanical mechanism below the floors of each smaller chambers are all linked together and mechanically coupled to the activation dial 18 such that they are configured to move one sliding piece from each of the four smaller chambers at the same time when the activation dial 18 is rotated. Accordingly, in unison and at the same time, each mechanical mechanism moves one sliding piece from its smaller chamber along the aligned tracks, outward radially from the center of that smaller chamber and inward toward the center of the central chamber. As explained earlier, in a preferred embodiment, as inner-most sliding piece—i.e. the sliding piece closest to the central chamber of each rotating floor in each chamber, is the piece that is moved.

Figure 4:
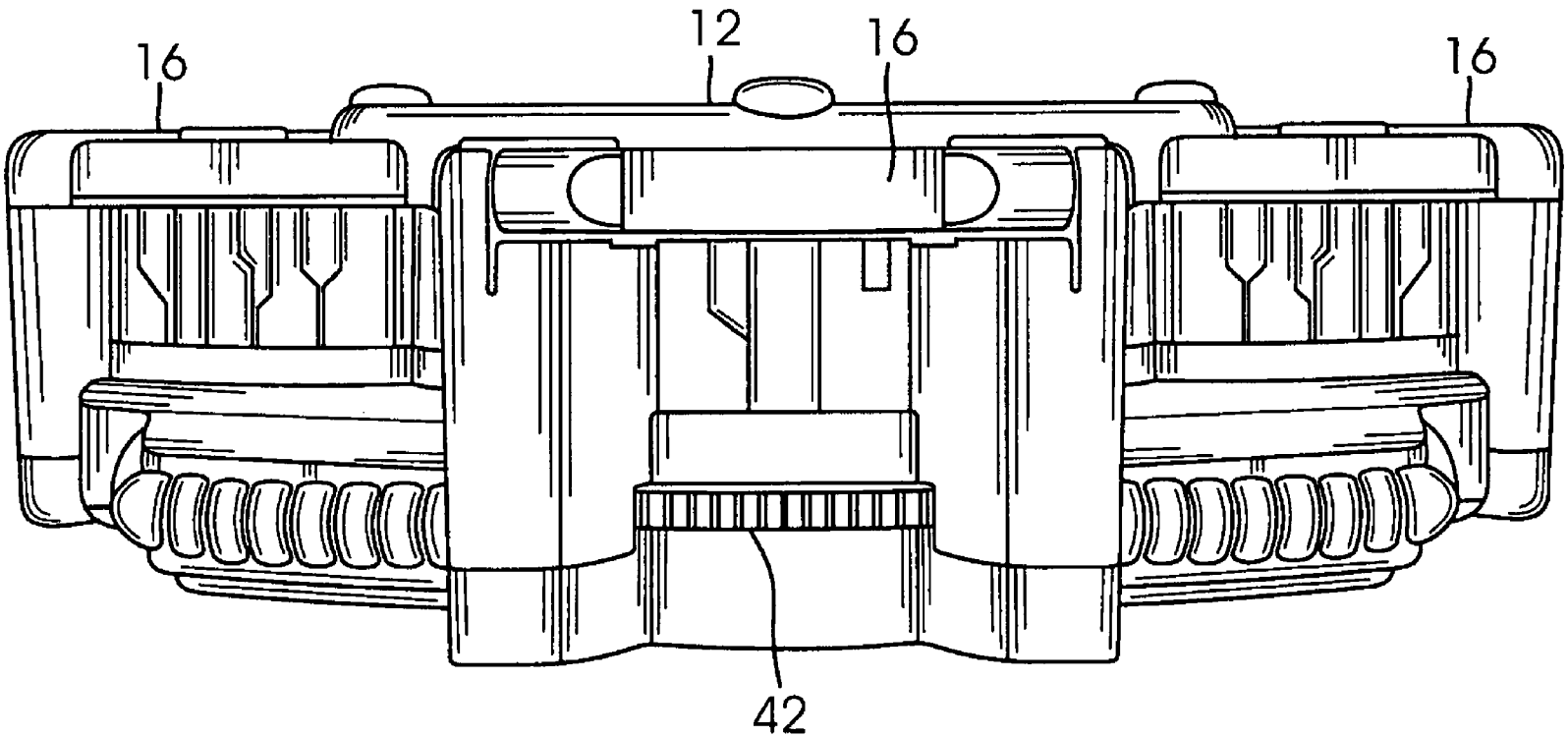
FIG. 4, illustrates a selection dial for internally rotating the floor of one of the smaller chambers, thereby causing the action figure body parts within that chamber to rotate.

In a preferred embodiment, and as will be disclosed further hereinafter, a user selects which of the at least four sliding pieces moves by using a selection dial which is positioned just below each of the respective smaller chambers. Referring to FIG. 4, there is illustrated a selection dial 42 for internally rotating the circular shaped floor 20 of one of the smaller chambers 16, thereby causing the alien action figure body parts arranged circumferentially around the floor within that chamber to rotate as well. As shown, below each of the smaller chambers, on the outside, is visible a selection dial 42. This dial may be rotated/turned manually by a user to any one of at least four possible positions. As the dial is rotated into each of the at least four possible positions, the floor inside the smaller chamber corresponding with that dial also rotates. As the floor rotates, the inner-most sliding piece—i.e. the sliding piece closest to the central chamber changes each time the dial is rotated into another position. Accordingly, each position of the selection dial 42 corresponds with aligning one of the at least four sliding pieces of the floor inside the smaller chamber corresponding with that dial position so that it is moved closer to the central chamber such that the position of the dial dictates which of the at least four sliding pieces of the floor in that smaller chamber will be moved when the toy is activated, as described in further detail hereinafter.

Figure 6:
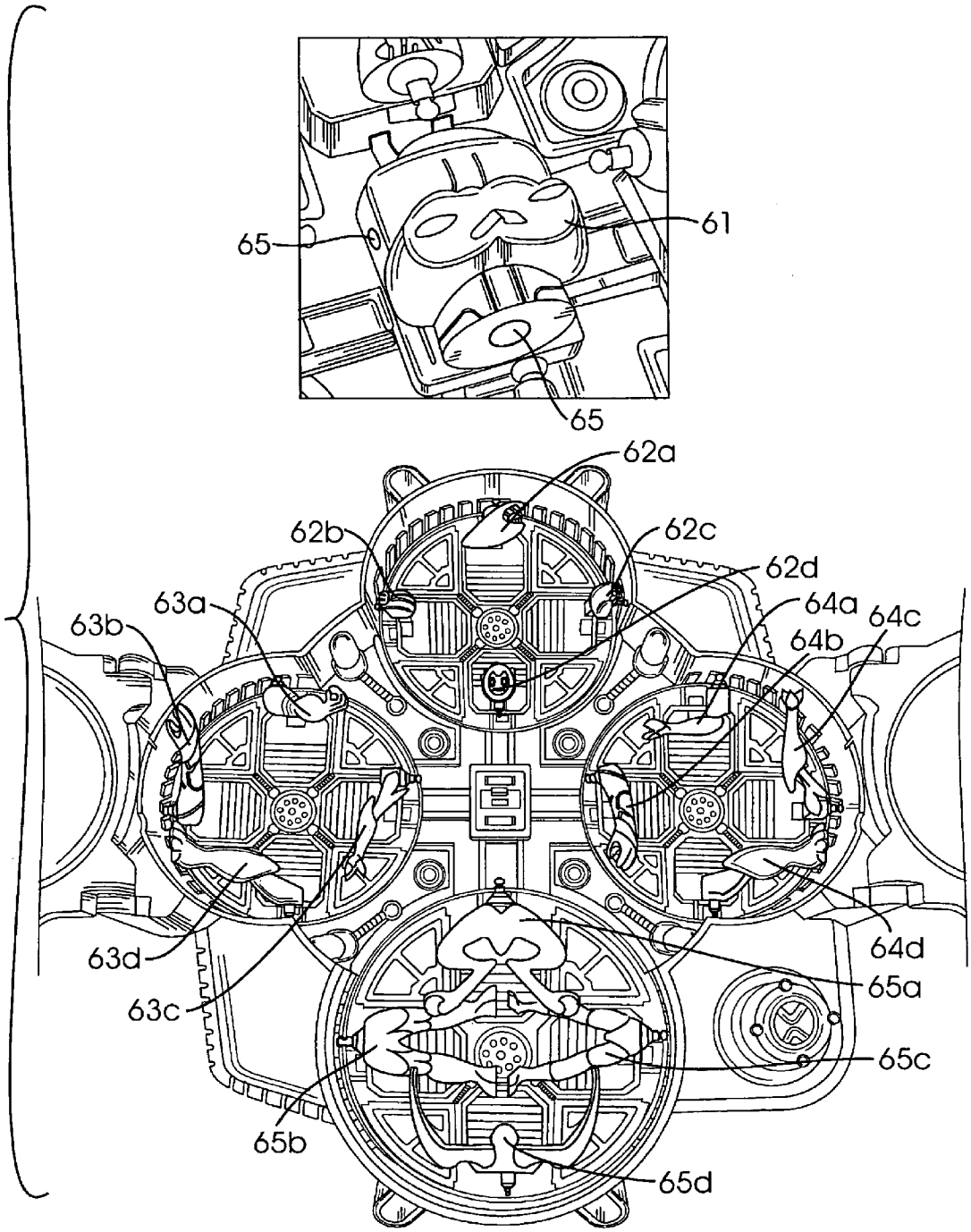
FIG. 6 illustrates how a preselected torso is placed in the center of the action figure fabrication toy of the present invention and how various action figure body parts are then arranged in each of the at least four smaller chambers.

As explained earlier herein, in a preferred embodiment of the present invention, a torso piece for an alien action figure is placed and retained within the central chamber using a clip or clasp 19 located in the central chamber of the present invention. Remaining action figure body parts are then arranged in each of the at least four smaller chambers. These body parts will be used to form one alien action figure toy using the present invention. FIG. 6 illustrates how a preselected torso is placed in the center of the alien action figure fabrication toy of the present invention and how various alien action figure body parts are then arranged in each of the at least four smaller chambers. As shown in FIG. 6, in a preferred embodiment, an alien action figure torso 61 is preferably equipped with an opening which is positioned centrally on the back side of the torso piece such that the piece is held in place within the central chamber by the clip or clasp 19, as described earlier herein. The torso also includes fastening apertures 65 which are preferably arranged on opposite sides of the torso for coupling individual action figure body parts (such as a head, arms and legs) to the torso. As explained earlier herein, a user may select the torso piece to be used from a plurality of torso pieces. Accordingly, each torso piece in the plurality is different in size, color and shape but all torso pieces are preferably configured with an opening centrally on their individual back sides. As further explained earlier herein, in a preferred embodiment the fastening apertures 65 only open and become visible when the torso piece is placed on the clip or clasp 19 in the central chamber. In this way action figure body parts can only be attached to the torso piece when using the fabrication toy of the present invention.

As further explainer earlier herein, and still referring to FIG. 6, each individual additional smaller chamber will hold a plurality of body parts for the alien action figure which will be used when it is assembled. For example, as shown in the illustration of FIG. 6, the top smaller chamber holds a plurality of action figure heads 62*a-d*, the left side small chamber holds a plurality of right arms 63*a-d*, the right side small chamber holds a plurality of left arms 64*a-d*, and the bottom smaller chamber will hold a plurality of leg pairs 65*a-d*. These action figure body parts are arrange circumferentially about the circular floor of each chamber and are held into place using the retaining apertures in each of the sliding pieces of the floors. Accordingly, in a preferred embodiment, each action figure body part includes a mounting post which is positioned centrally on a back side of the piece and which fits into a retaining aperture when the piece is placed in one of the smaller chambers. In this way, one action figure piece is positioned on each sliding piece of the circular floor in each chamber and held in place so it will not move when the floor starts to rotate.

Figure 5:
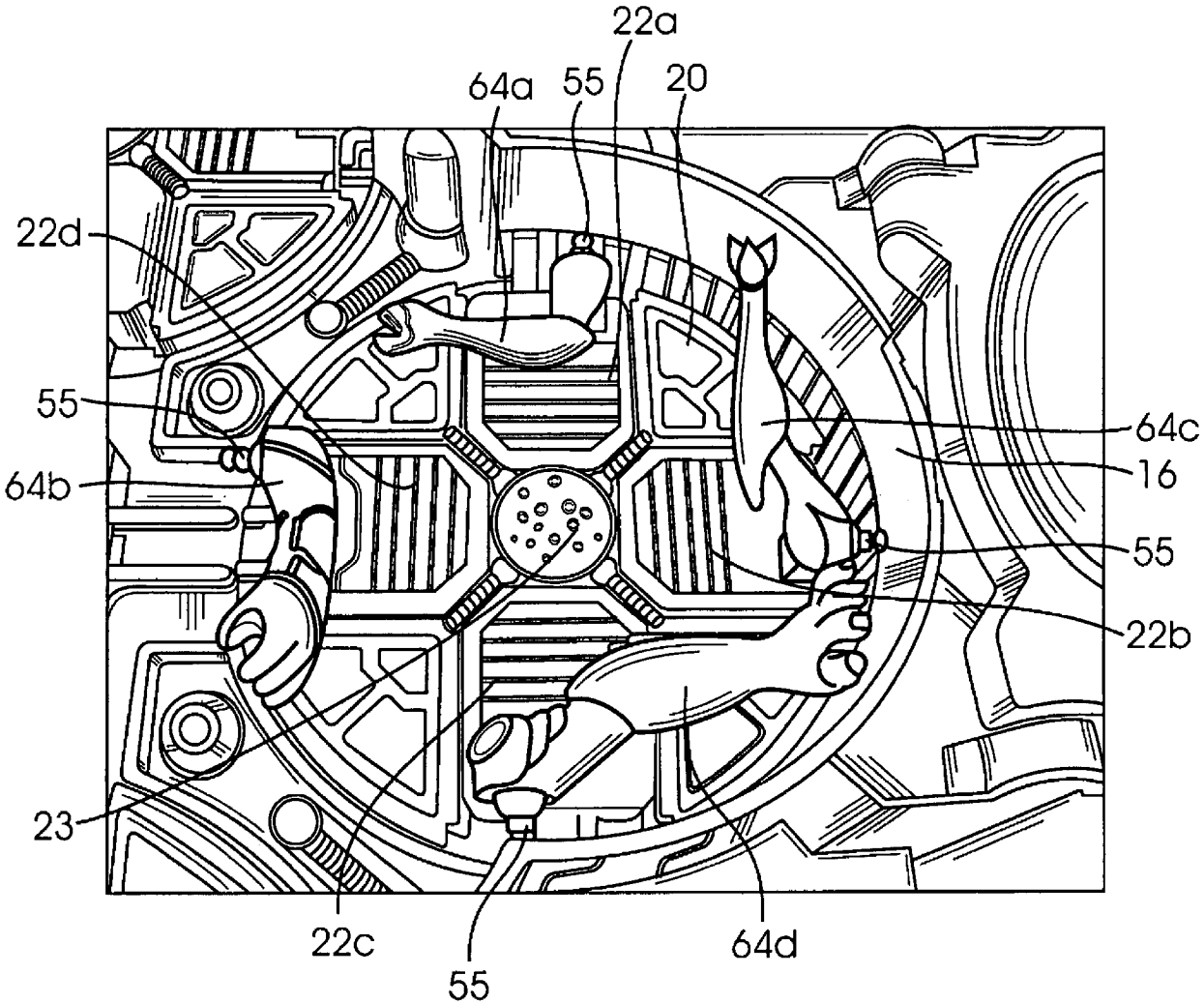
FIG. 5 illustrates how various individual body parts for an action figure are arranged in one of the chambers of the action figure fabrication toy of the present invention.

FIG. 5 illustrates in further detail how individual body parts (in this case right arms) are arranged in one of the at least four smaller chambers 16 of the alien action figure fabrication toy of the present invention. As shown in FIG. 5, the individual action figure parts are positioned circumferentially around the outer perimeter of the rotating circular shaped floor 20 of the smaller chamber 16. The action figure parts (in this case left arms) are preferably positioned such that there is one body part positioned on each of the four separate sliding pieces 22*a-d* of the rotating floor. More specifically, a single body part is positioned on top of one of the sliding pieces of the rotating floor such that it is held in place using the retaining aperture in that piece 22*a-d*. Each body part has a fastening post 55 which allows the body part to be coupled to the torso piece in the central chamber. More specifically, the torso preferably includes fastening apertures 65 which are preferably arranged on opposite sides of the torso. The fastening posts 55 on each of the body parts are inserted into the fastening apertures of the torso, when that piece is selected, for coupling that individual action figure body part (such as a head, arm or pair of legs) to the torso.

After all the at least four smaller chambers have been loaded with their respective alien action figure body parts, the lid is preferably placed back on top of the unit. A user then rotates the selection dials at the bottom/outside of each of the smaller chambers while looking through the window of the lid. The user will rotate each dial until the piece desired from that respective chamber comes into view and is positioned adjacent/closest to the torso held in the middle of the central chamber. Once the user has selected all the desired pieces he/she wishes to be coupled to the torso in order to create a desired alien action figure, the user will turn the activation dial 18 in a first direction, causing the closest sliding piece from each of the circular rotating floors of each of the four chambers to move outward, radially, away from that smaller chamber and inward, toward the central cavity and the torso, thereby causing the alien action figure part to also move outward toward the torso.

Figure 7:
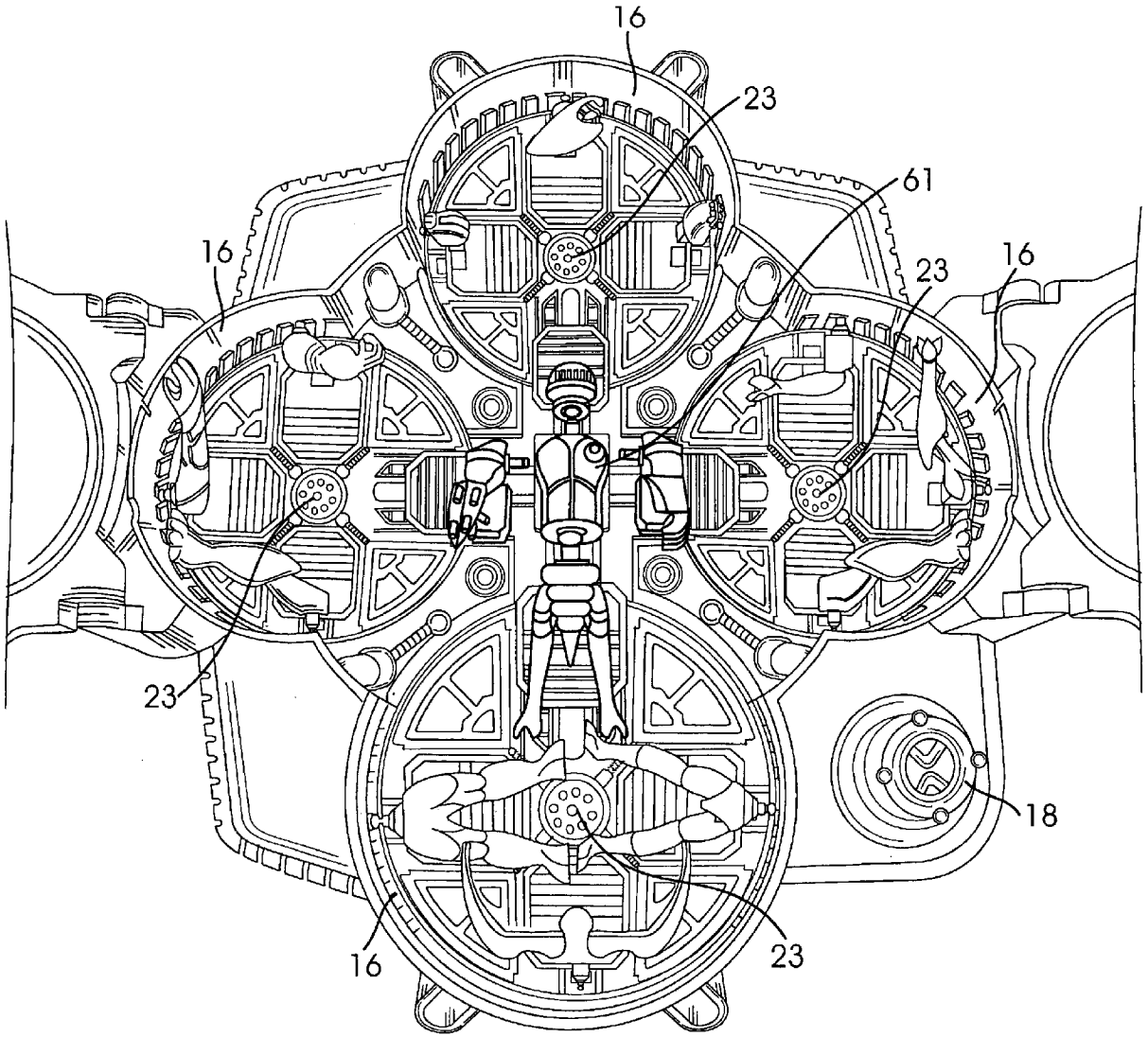
FIG. 7 illustrates the concept of how the closest sliding piece from the floor of each smaller chamber moves outward, radially, away from the center of that smaller chamber and inward, toward the central chamber (toward the torso piece)
Figure 8:
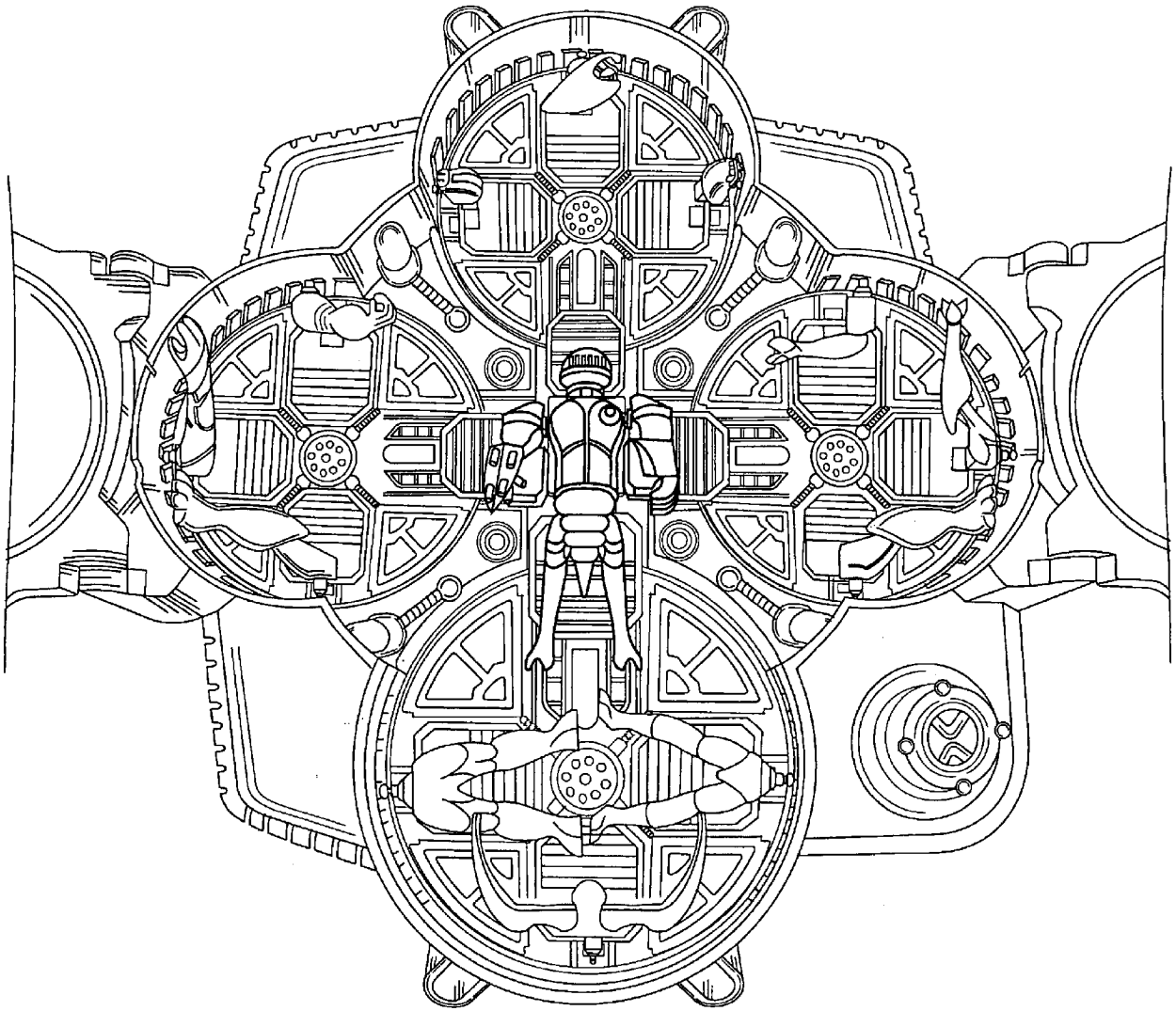
FIG. 8 shows a complete action figure comprised of the various body parts which have been selected and automatically attached from each of the smaller chambers in accordance with a preferred embodiment of the present invention.

FIG. 7 illustrates the concept of how the closest sliding piece from the floor of each smaller chamber moves outward, radially, away from the smaller chamber and toward the torso. As shown in FIG. 7, one sliding piece from each smaller chamber moves outward radially, away from the central axis of that chamber and toward the center of the toy. One action figure body part is located on top of this sliding piece and will also move toward the torso (with the sliding piece). Once the sliding piece is close enough the body part positioned on top of that piece eventually couples with the torso, thereby forming a complete alien action figure comprised of several component parts selected by the user. More specifically, once close enough to the torso piece, the fastening post 55 of that piece will snap and insert into one of the fastening apertures of the torso, thereby coupling the pieces (the body part and the torso) together. FIG. 8 further illustrates this concept. More specifically, FIG. 8 shows a complete action figure comprised of the various body parts from each smaller chamber.

It is understood that since the body parts are positioned circumferentially about the rotating floors, which are then rotated using the selection dial positioned beneath each smaller chamber, a user can create a myriad of different, desirable action figures using any combination of the different parts available. More specifically, the user can look through the window of the lid of the toy as each selection dial is rotated and selected any one of a myriad of possible combinations of body parts in order to form one complete action figure.

In an alternative method, the window may be blocked such that the user cannot see which body parts are going to be used to assemble the alien action figure. In this embodiment, a cover is inserted to block the window in the lid so a user cannot see what is happening inside the central chamber. The user then rotates each selection dial below each smaller chamber into any position he or she desires. However, this time the user cannot see the results of that selection through the window—i.e. the user cannot see which one of the body parts/sliding pieces in each of the four smaller chambers will be positioned adjacent/closest to the torso. Once the user set all four selection dials into desired positions, the user will turn the activation dial in a first direction, causing the closest sliding piece from the circular rotating floors of each of the smaller chambers to move outward, radially, toward the torso, thereby causing the alien action figure part to also move outward toward the torso. Each sliding piece moves toward the center of the toy, and when close enough the alien action figure body part positioned on that piece actually couples with the torso positioned in the central cavity, thereby forming a complete alien action figure.

Accordingly, in this way the body parts used/selected to assemble the alien action figure may be either specifically selected by the user and/or they may be randomly selected, such that the final composite alien action figure which is assembled may be designed with a particular appearance in mind or it may be a random combination of body parts—thereby forming a unique alien action figure—which the user does not know the outcome of until the action figure has been fully assembled.

With respect to the above description, it is to be realized that variations such as the configuration of the unit (shape and size), the size and shape of each chamber, the relative number of smaller chambers, the alien action figure body parts used in each chamber, and the rules of play may be altered and/or changed and still fall within the scope of protection granted by this description. Therefore, the foregoing is considered as illustrative only of the principles of the invention and shall not serve to limit or restrict the scope of this application.

What is claimed is:

1. An action figure fabrication toy comprised of:

a central chamber for retaining a torso piece of an action figure to be built using the toy;

a plurality of smaller chambers positioned about the central chamber, each of said smaller chambers configured to hold a plurality of action figure body parts;

wherein each of the plurality of smaller chambers includes a rotating floor configured to rotate about a central axis within said smaller chamber in which it is disposed; and wherein one body part from each of the plurality of body parts in each of the plurality of smaller chambers is automatically coupled to the torso piece retained in the central chamber when the toy is activated.

2. The action figure fabrication toy of claim 1 wherein the individual rotating floor is comprised of a plurality of individual sliding pieces, which together form the floor, but which are each capable of sliding outward, in a radial fashion, away from the central axis about which the floor rotates.

3. The action figure fabrication toy of claim 2, wherein each sliding piece includes a retaining aperture for holding one of the alien body parts in the plurality contained within that particular smaller chamber.

4. An alien action figure fabrication toy comprised of:

a central chamber for retaining a torso piece of an alien action figure to be built using the toy;

at least four smaller chambers positioned circumferentially about the central chamber, each for holding a plurality of alien action figure body parts;

wherein an individual rotating floor is disposed within each of the at least four smaller chambers, each floor configured to rotate about a central axis within said smaller chamber in which it is disposed; and wherein one body part from each of the plurality of body parts in each of the at least four smaller chambers is automatically coupled to the torso piece retained in the central chamber when the toy is activated.

5. The alien action figure fabrication toy of claim 4 wherein the individual rotating floor within each of the at least four smaller chambers is comprised of at least four individual sliding pieces which are capable of sliding outward, in a radial fashion, away from the central axis about which the floor rotates.

6. The alien action figure fabrication toy of claim 5, wherein each sliding piece includes a retaining aperture for holding one of the alien body parts in the plurality contained within that particular smaller chamber.

7. A toy for automatically assembling an action figure having a torso piece, a head piece, a left arm piece, a right arm piece, and a pair of legs piece, said toy comprising:

a central chamber for retaining the torso piece of the action figure;

a first smaller chamber positioned adjacent to the central chamber for retaining a plurality of head pieces;

a second smaller chamber positioned adjacent to the central chamber for retaining a plurality of right arm pieces;

a third smaller chamber positioned adjacent to the central chamber for retaining a plurality of left arm pieces;

a fourth smaller chamber positioned adjacent to the central chamber for retaining a plurality of pair of leg pieces;

wherein each of the four smaller chambers includes a rotating floor configured to rotate about a central axis within said smaller chamber; and wherein one piece from each of the four smaller chambers is automatically coupled to the torso piece retained in the central chamber when the toy is activated.

8. The toy of claim 7 wherein the rotating floor within each of four smaller chambers is comprised of at least four individual sliding pieces capable of sliding outward, in a radial fashion, away from the central axis about which the floor rotates.

9. The toy of claim 8, wherein each sliding piece includes a retaining aperture for holding one of the pieces in the plurality contained within that particular smaller chamber.

10. A method for building an action figure comprised of:

retaining a torso piece of an action figure to be built within a central chamber;

positioning a plurality of action figure body parts within a plurality of smaller chambers arranged around the central chamber;

automatically moving one body part from each of the plurality of smaller chambers toward the torso piece retained in the central chamber until it couples with the torso piece; and rotating the plurality of body parts within each smaller chamber wherein each of the plurality of smaller chambers includes a rotating floor configured to rotate about a central axis within said smaller chamber in which it is disposed.

11. The method of claim 10 wherein the individual rotating floor is comprised of a plurality of individual sliding pieces, which together form the floor, but which are each capable of sliding outward, in a radial fashion, away from the central axis about which the floor rotates.

12. The method of claim 11, wherein each sliding piece includes a retaining aperture for holding one of the action figure body parts in the plurality contained within that particular smaller chamber.

* * * * *